US006003155A

United States Patent [19]

Silberman

[11] Patent Number: 6,003,155

[45] Date of Patent: Dec. 21, 1999

[54] SECURITY GARMENT

[76] Inventor: Régina Silberman, Van Eycklei 42 (Bus 8), B-2018 Antwerpen, Belgium

[21] Appl. No.: 08/864,536

[22] Filed: May 28, 1997

Related U.S. Application Data

[63] Continuation-in-part of application No. PCT/BE95/00107, Nov. 20, 1995.

[51] Int. Cl.[6] ..... A41D 3/08

[52] U.S. Cl. ..... 2/69.5; 2/88

[58] Field of Search ..... 2/456, 457, 69.5, 2/85, 87, 88, 244, 123, 69, 89, 125, 82, 83; D2/823, 825

[56] References Cited

U.S. PATENT DOCUMENTS

| | | | |
|---|---|---|---|
| D. 182,645 | 4/1958 | Cetrulo | D2/823 |
| 1,272,942 | 7/1918 | Goldstein | 2/88 |
| 2,644,948 | 7/1953 | Gutmann | 2/69.5 |
| 2,722,694 | 11/1955 | Bryant | 2/69.5 |
| 2,898,599 | 8/1959 | Seckendorf | 2/88 |
| 2,967,306 | 1/1961 | Fabanich | 2/69.5 |
| 3,153,244 | 10/1964 | Lowney, Jr. | 2/244 |
| 3,259,126 | 7/1966 | Greiert | 2/69.5 |
| 3,973,275 | 8/1976 | Blauer . | |
| 4,382,303 | 5/1983 | Lunt | 2/69.5 |
| 4,774,725 | 10/1988 | Page . | |
| 4,815,146 | 3/1989 | Theewis et al. | 2/244 |
| 5,588,156 | 12/1996 | Panton, Jr. | 2/244 |

FOREIGN PATENT DOCUMENTS

| | | |
|---|---|---|
| 1074476 | 10/1954 | France . |
| 2 394 055 | 1/1979 | France . |
| 2 496 419 | 6/1982 | France . |

*Primary Examiner*—Michael A. Neas
*Attorney, Agent, or Firm*—Sughrue, Mion, Zinn Macpeak & Seas, PLLC

[57] ABSTRACT

A garment designed for being wrapped round the shoulders of a user to attract the attention of a third person to the wearer. The garment comprises a back panel and a front panel extending straight down from the shoulders of the wearer, with an opening at the shoulders to accomodate the neck of the wearer. The back panel is configured to cover the width of the back and the left and right arms of the wearer. The front panel is configured to cover the chest and the left and right arms of the wearer. Preferably, means are provided for connecting the back and front panels to each other at both sides of the wearer's waist such that, when the coat is being worn by a person, said back and front panels are held close to the wearer's body.

18 Claims, 3 Drawing Sheets

SECURITY GARMENT

CROSS-REFERENCE TO RELATED APPLICATIONS

This application is a continuation-in-part of international application No. PCT/BE95/00107 filed Nov. 20, 1995, having priority dates of Nov. 28, 1994 and Nov. 14 1995.

BACKGROUND OF THE INVENTION

The present invention relates to a garment which may be worn over ordinary clothing to attract the attention of a third person to the wearer of the coat.

Protective garments or suits to provide protection of a wearer against injury or attack are known. An example of armored garment is shown in U.S. Pat. No. 3,973,275 and an example of fireman's coat is disclosed in U.S. Pat. No. 4,774,725.

Until now there has not been available a garment which can be quickly and easily slipped on by a user who is suddenly faced with a dangerous situation. A typical dangerous situation is when a car driver leaves his car in case of breakdown, changing a tire or looking for help for instance. Another exemplary dangerous situation is a cyclist or a pedestrian walking in cases of bad visibility.

It is therefore an object of the present invention to provide a garment which enables a user to be quickly visible to third persons in any situation where the user is running a risk.

Another object of this invention is to provide a garment which is quick and easy to manufacture.

SUMMARY OF THE INVENTION

The present invention provides a garment for being worn over ordinary clothing to attract the attention of a third person to a wearer. The garment comprises a back panel and a front panel extending straight down from the shoulders of the wearer, with an opening at the shoulders to accomodate the neck of the wearer. Advantageously, the back and front panels are made in a single unit. The back panel is configured to cover the width of the back and the left and right arms of the wearer. The front panel is configured to cover the chest and the left and right arms of the wearer. Preferably, means are provided for connecting the back and front panels to each other at both sides of the wearer's waist such that, when the coat is being worn by a person, said back and front panels are held close to the wearer's body.

The garment of this invention is lightweight and allows full freedom of movement. Further, it can be quickly and easily donned in any situation. For instance, a car driver can easily slip the inventive garment on, while still sitting in the car. This insures that, on leaving his car the driver can be clearly noticed by the drivers of oncoming cars, thereby reducing considerably the chances of the wearer being hit.

The garment is advantageously made of a supple material, preferably of a fluorescent and/or reflective material, whereby the wearer is perfectly visible to a third person whatever the environment may be, e.g. on highways, dark or poorly enlightened places such as underground car parks, works, yards, warehouses, etc.

Because the front and back panels of the garment are held on both sides of the wearer's waist, the garment panels are prevented to be raised by the wind or by an air blast. As a result, the front and back panels are always held close to the wearer's body, thereby ensuring that the garment, and thus the wearer, is always perfectly visible in dangerous situations. Therefore, the invention provides the user the maximum protection against personal injuries and fatal accidents.

In a preferred embodiment, warning marks may be affixed to the front and/or back panels. Such warning marks, which may be for instance in the form of triangles made of fluorescent or reflective contrasting strips, improve the visible character of the garment and thus the protection of the wearer. As an optional feature, the strips are fitted with fluorescent or reflective braid. Also arrangements may be provided to make the front and back panels flame-retardant or bullet-proof.

Another advantage of the garment of the present invention is that it is quick and easy to manufacture from one single piece of material.

The garment as described herein before may be provided with a hood or other protection means for the user's head. It should be realized that the hood can be made detachable.

The invention will now be better understood from the following detailed description when taken in conjunction with the accompanying drawings.

DETAILED DESCRIPTION OF PREFERRED EMBODIMENTS

Figure 1:
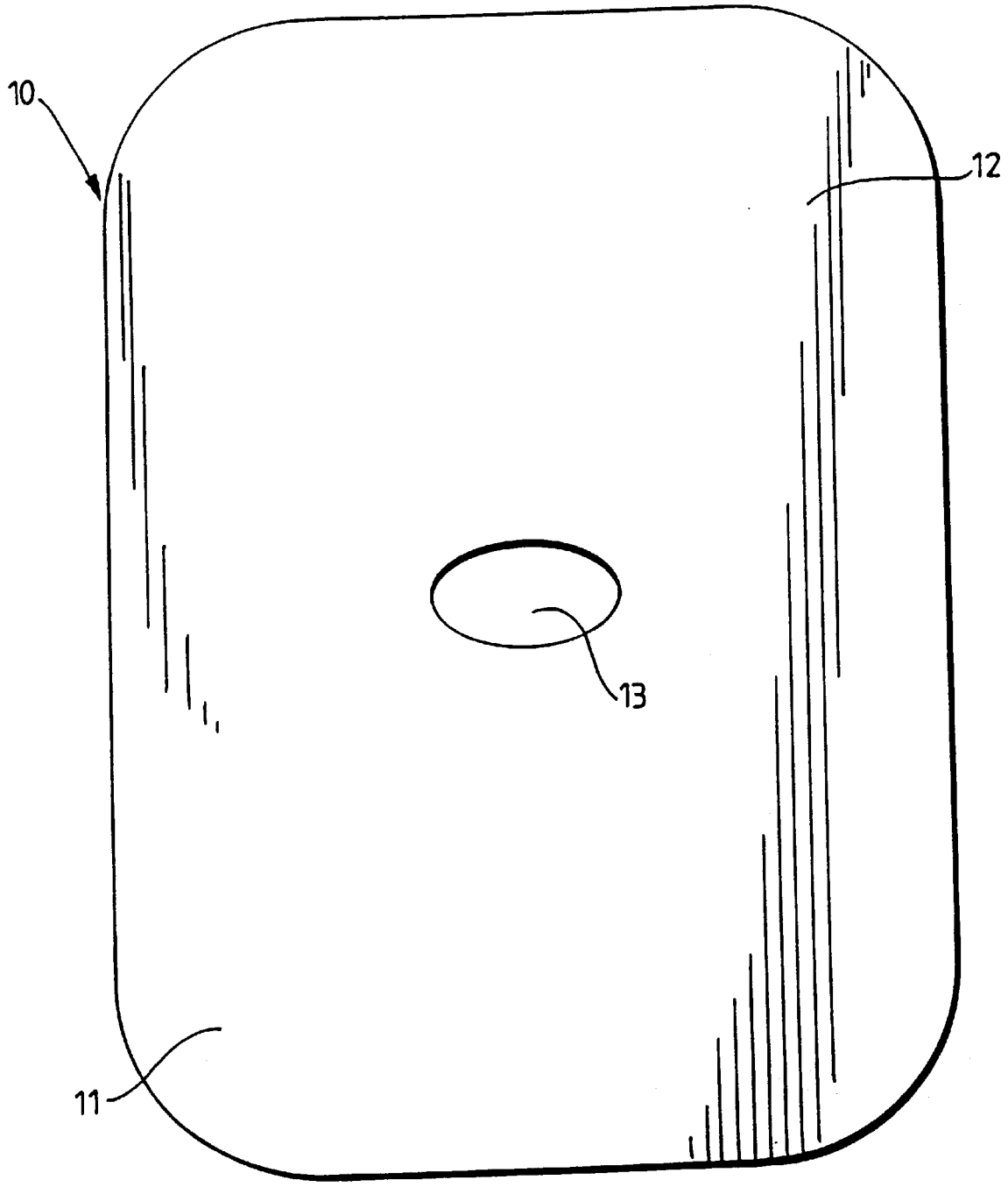
FIG. 1 is a plan view of a garment of the present invention with the panels separated in order for the garment to lie flat.

Referring to FIG. 1, there is shown a plan view of a blank 10 from which the garment of the present invention is fabricated. The front panel 11 is advantageously made of one piece with the back panel 12 of similar configuration and size before which the front panel 11 is turned down from the shoulders. The blank 10 has an opening 13 formed therein to accomodate the neck of a wearer.

Figure 2:
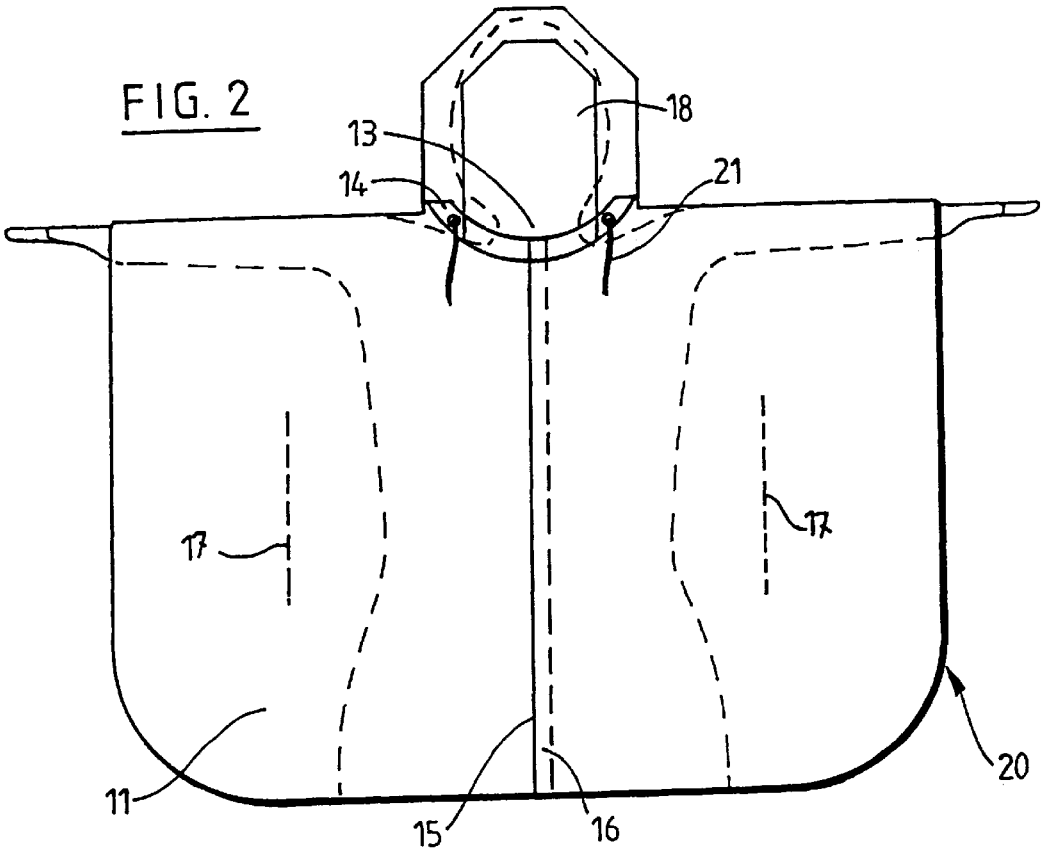
FIG. 2 is a front view of the garment of FIG. 1, displayed on a mannequin.
Figure 3:
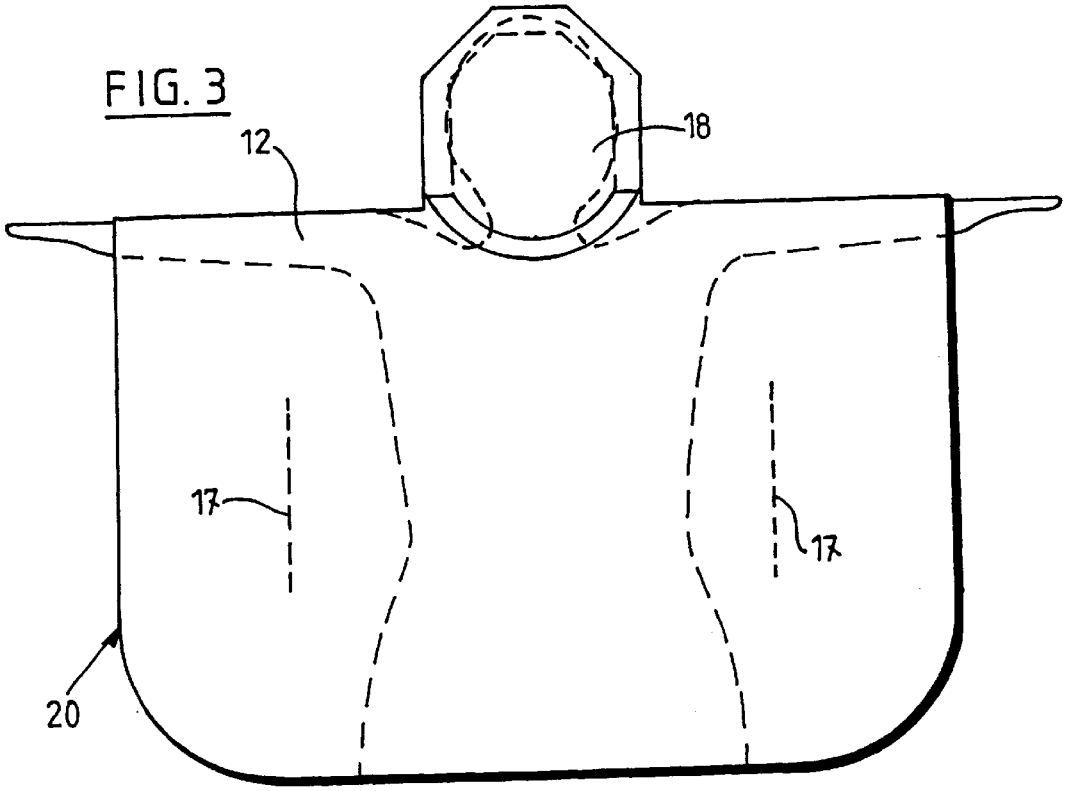
FIG. 3 is a rear view of the garment shown in FIG. 2.

The front panel 11 is configured to cover the chest as well as the left and right arms of a user. Similarly, the back panel 12 is configured to cover the width of the back as well as the left and right arms of the user. Each of the front and back panels is configured so as to extend below the waist of a user. Referring now to FIGS. 2 and 3 there are shown the breast and the back of a garment made from the blank 10 of FIG. 1 fashioned into a completed garment 20 according to the invention and displayed on a mannequin. In the specific example shown, a stand-up collar 14 is provided. Also a front opening 15 extends from the neck opening 13 and is fitted with fastener means 16 e.g. fastener strips or pads such as Velcro ® fastener strips, snap or dome fasteners, etc. The back and front panels are connected to each other by left and right lines of stitching 17 or welded joints or else at both sides of the wearer's waist. When the garment 20 is worn, over ordinary clothing, the left and right stitching 17 hold the front and back panels close to the wearer's body, thereby preventing the front and back panels to be raised by the wind or by air blast.

The aforementioned lines of stitching 17 or other connecting means do not need to extend high under the wearer's arms. They are only provided at waist level so as to leave ample space between the front and back panels for allowing easy passage of and free movement for the wearer's arms while ensuring that the garment completely covers the wearer's body.

As noted earlier herein, the garment shown in FIGS. 2 and 3 can be quickly and easily donned by a user. The user only has to unfasten the front fastener means when so provided and to wrap the garment round the shoulders. The garment thus provides comfortable protection while allowing full freedom of movement.

In the embodiment shown in FIGS. 2 and 3, the garment includes a hood 18 for the protection or the user's head. Obviously, the hood can be made detachable.

The garment of the invention is preferably made of a supple material, for instance in a bright fluorescent yellow color. Avantageously, the front and back panels are fitted with warning marks to improve the visible character of the garment and consequently the protection of the wearer.

Figure 4:
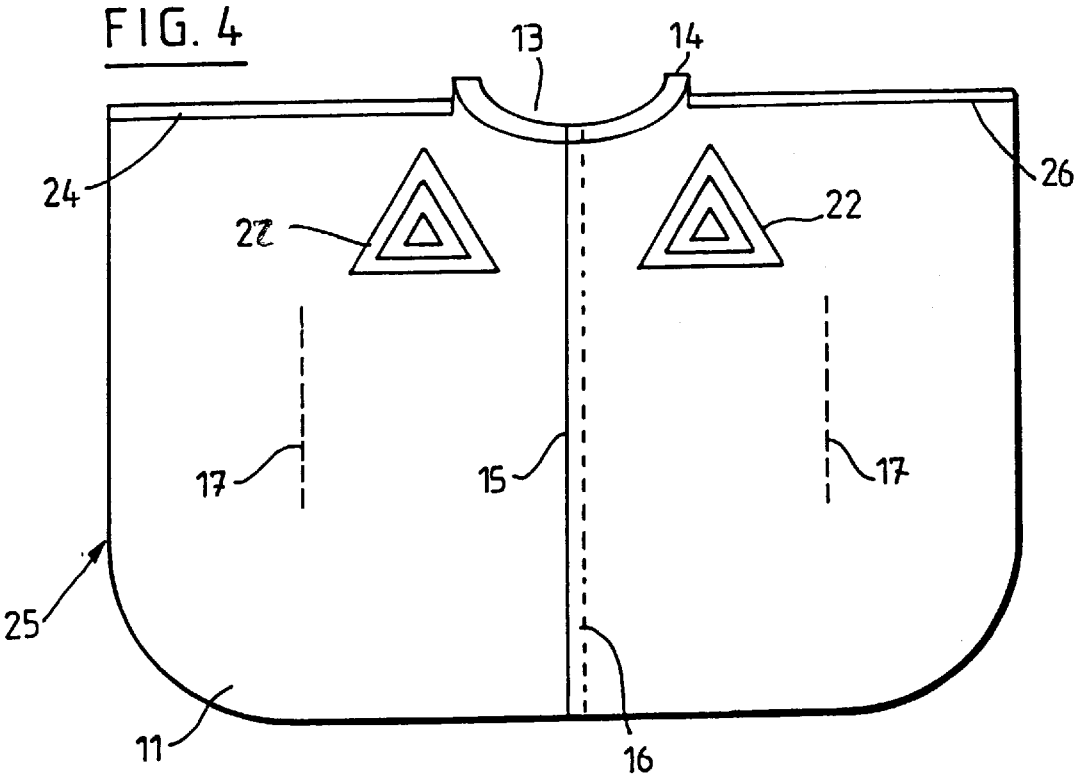
FIG. 4 is a front view of another embodiment of the garment of the present invention.
Figure 5:
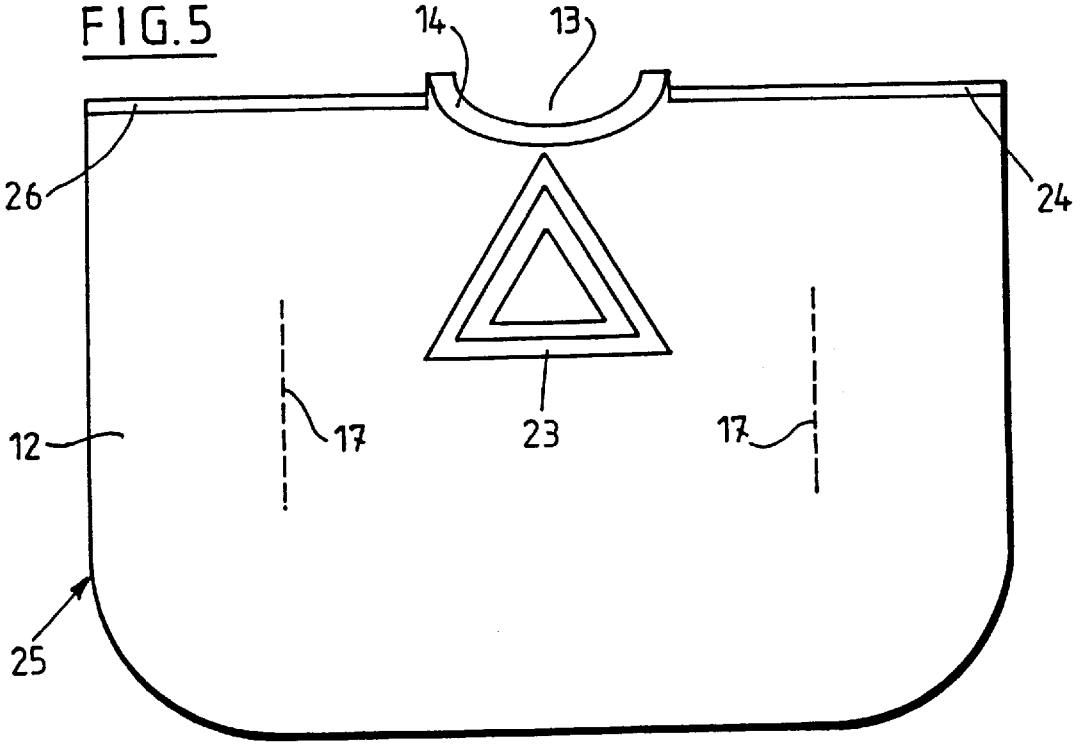
FIG. 5 is a rear view of the garment shown in FIG. 4.

FIGS. 4 and 5 show a preferred embodiment of the protection garment of the invention comprising a front panel 11 and a back panel 12 with an opening 13 to accomodate the neck of a wearer. FIGS. 4 and 5 show a garment 25 similar to the one shown in FIGS. 2 and 3, but without a hood for the head of the wearer, which hood may be provided as a separate item. In addition, the front and back panels are provided with contrasting warning marks in the form of triangles made from reflective strips. In the exemplary embodiment illustrated, two triangles are affixed to the front panel 11 and one larger triangle 23 for instance can be provided on the back panel 12. Such warning marks enhance the visibility of the garment from afar.

Advantageously, fluorescent or reflective contrasting strips can also be provided along the shoulders lines as illustrated at 24 and 26 in order to enhance the visibility of the garment sideways. As an optional and advantageous feature the strips and/or warning marks can be fitted with fluorescent or reflective contrasting braids thereby to further improve the visibility of the garment from afar.

As another optional feature the garment may be made of or covered with a waterproof and/or flame-retardant material. Yet, the garment may be made of a ballistic material or the front and/or back panels may be arranged to have bullet-proof protective properties.

I claim:

1. A garment for being wrapped round the shoulders of a user to attract the attention of a third person to a wearer, said garment comprising:

a back panel and a front panel extending straight down from the shoulders of the wearer, with an opening to accommodate the neck of the wearer, said back panel being configured to cover the width of the back and the left and right arms of the wearer, said front panel being configured to cover the chest and the left and right arms of the wearer, said back panel being permanently connected to said front panel at positions substantially in the middle, both longitudinally and laterally, of the left and right half portions of said front and back panels and said garment being made from a substantially rectangular blank.

2. The garment as defined in claim 1, further comprising means for connecting said back and front panels to each other at both sides of the wearer's waist such that, when the coat is being worn by a person, said back and front panels are held close to the wearer's body.

3. The garment as defined in claim 1, wherein the front and back panels are made in a single unit.

4. The garment as defined in claim 1, wherein the front panel has an opening extending from the neck opening edge, said opening being provided with fastener means.

5. The garment as defined in claim 1, wherein at least one of said panels is made of a fluorescent material.

6. The garment as defined in claim 1, wherein at least one of said panels is provided externally with fluorescent contrasting strips.

7. The garment as defined in claim 1, wherein at least one of said panels is provided externally with fluorescent warning marks.

8. The garment as defined in claim 6, wherein the contrasting strips are fitted with contrasting fluorescent braid.

9. The garment as defined in claim 7, wherein the warning marks are fitted with contrasting fluorescent braid.

10. The garment as defined in claim 1, wherein said panels include fireproof material.

11. The garment as defined in claim 1, comprising attachment means for attaching protection means for the head of a wearer.

12. The garment as defined in claim 1, including protection means for the head of a wearer.

13. The garment as defined in claim 1, wherein at least one of said panels is made of reflective material.

14. The garment as defined in claim 1, wherein at least one of said panels is provided externally with reflective contrasting strips.

15. The garment as defined in claim 1, wherein at least one of said panels is provided externally with reflective warning marks.

16. The garment as defined in claim 6, wherein the contrasting strips are fitted with contrasting reflective braid.

17. The garment as defined in claim 7, wherein the warning marks are fitted with contrasting reflective braid.

18. The garment as defined in claim 1, wherein said panels include ballistic material.

* * * * *